United States Patent [19]

Liu

[11] Patent Number: 4,930,231

[45] Date of Patent: Jun. 5, 1990

[54] SHOE SOLE STRUCTURE

[76] Inventor: Su H. Liu, No. 41-2, Lane 24, Shin Kang Rd., Lin-Ya Dist., Kaohsiung, Taiwan, 800

[21] Appl. No.: 306,907

[22] Filed: Feb. 7, 1989

[51] Int. Cl.[5] ..... A43B 13/02; A43B 13/37; A43B 13/42

[52] U.S. Cl. ..... 36/30 A; 36/33; 36/30 R

[58] Field of Search ..... 36/13, 22 R, 22 A, 25 R, 36/30 R, 30 A, 31, 32 R, 33, 76, 85, 86, 11.5

[56] References Cited

U.S. PATENT DOCUMENTS

| | | | |
|---|---|---|---|
| 981,154 | 1/1911 | Austin | 36/30 A |
| 1,308,395 | 7/1919 | Case | 36/30 A |
| 1,976,389 | 10/1934 | Everston | 36/30 A |
| 2,124,819 | 7/1938 | Halloran | 36/30 A |
| 2,405,224 | 8/1946 | Margolin | 36/30 R |
| 4,476,638 | 10/1984 | Quacquarini et al. | 36/84 |
| 4,557,060 | 12/1985 | Kawashima | 36/30 R |
| 4,608,768 | 9/1986 | Cavanagh | 36/30 R |
| 4,624,061 | 11/1986 | Wezel | 36/30 A |

*Primary Examiner*—Donald Watkins

*Attorney, Agent, or Firm*—Fleit, Jacobson, Cohn, Price, Holman & Stern

[57] ABSTRACT

An improved shoe sole structure, wherein the sole made of rubber comprises a plurality of crosswise parallel grooves in the upper face of the front half section and a large recess in the upper face of the rear half section, and the grooves are filled in and glued with wooden strips and the recess filled in and glued with a wooden board.

4 Claims, 3 Drawing Sheets

SHOE SOLE STRUCTURE

BACKGROUND OF THE INVENTION

Conventional slippers or sandals generally have soles made of plastics, rubber or leather, which may often be pierced through by an pointed object such as nails or may give uncomfortable feeling to a wearer even if they are not pierced through. Besides, they can hardly soak the sweat or odor feet may give out so that the wearer may often be apt to get a skin disease.

SUMMARY OF THE INVENTION

Therefore, this invention has been devised to improve the defects of conventional slippers or sandals.

This improved shoe sole structure in accordance with the present invention aims to prevent it from being pierced through by a pointed object so as to guard wearer's feet safely, to equip it with good ventilation and coolness, and to give it flexible property as well.

The sole is provided with a plurality of crosswise parallel grooves in the upper face of the front half section and a large recess in the upper face of the rear half section. The grooves are filled in and glued with wooden strips, and the large recess is also filled in and glued wth a wooden board. These wooden strips and the board are useful in soaking the sweat coming out from the feet so that they can prevent skin disease or bad odor for a wearer.

BRIEF DESCRIPTION OF THE DRAWINGS

This invention will now be described in detail with reference to accompanying drawings wherein.

DETAILED DESCRIPTION OF THE INVENTION

Figure 1:
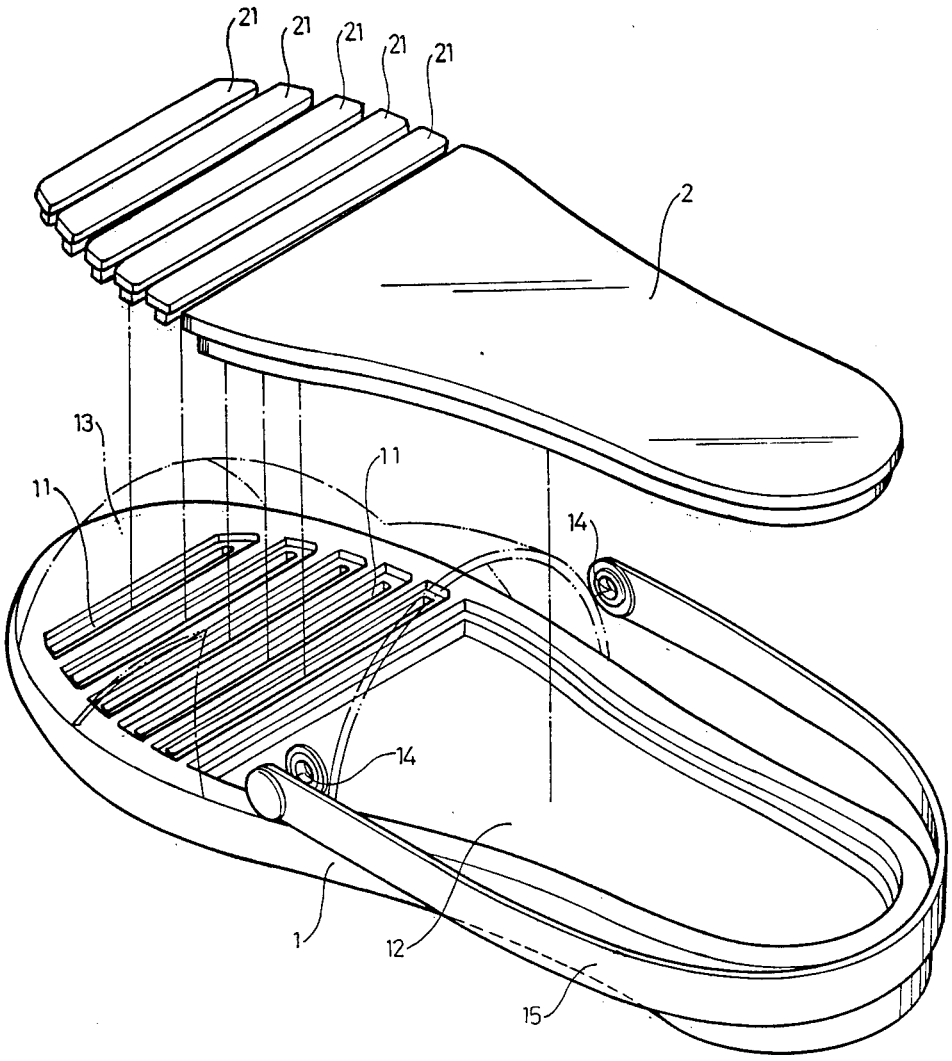
FIG. 1 is an exploded perspective view of the improved shoe sole structure combined in a sandal in accordance with the present invention.

As FIG. 1 shows, this improved shoe sole structure compises a flexible rubber sole 1 having a plurality of crosswise parallel grooves 11 in the upper face of the front half section and a large recess 12 in the upper face of the rear half section. The grooves 11 are filled in and glued with wooden strips 21, and the recess 12 is filled in and glued with a wooden board 2. A vamp 13 is provided to cover the upper section above the front section for a foot to wear in and a strap 15 is provided with fasteners 14 fastening both the ends on the vamp for the foot heel to hang on.

Figure 2:
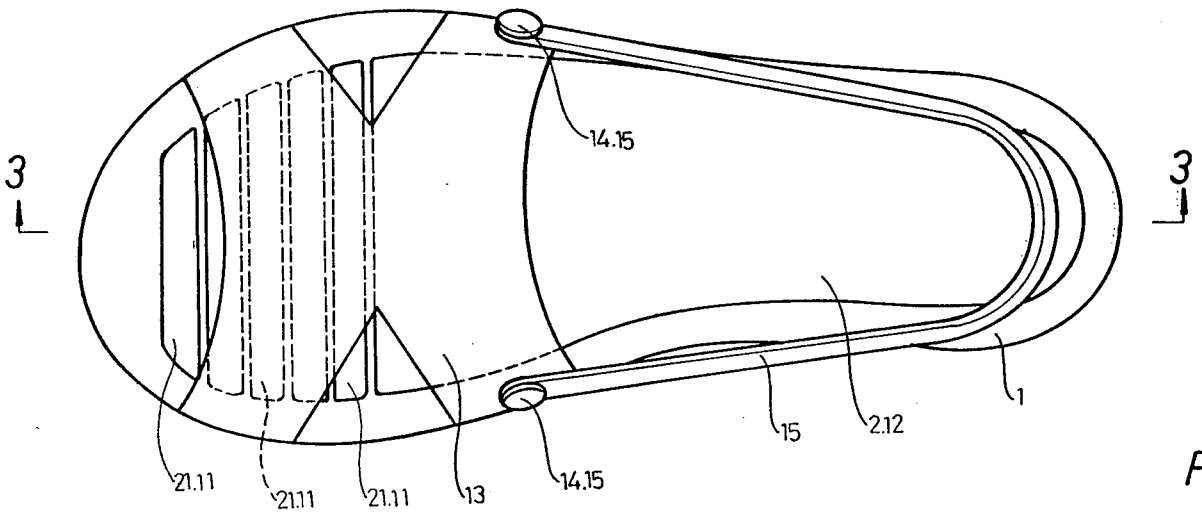
FIG. 2 is a side view of the improved shoe sole structure combined in a sandal in accordance with the present invention.
Figure 3:
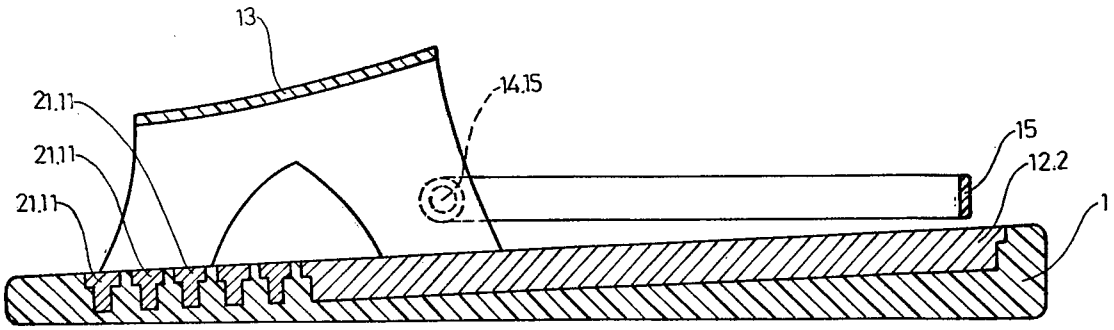
FIG. 3 is a cross-sectional view of taken along line 3—3 of FIG. 2.

Then FIGS. 2 and 3 show that the shoe sole made according to the present invention has the large section made of wood which has good ventilating characteristic so that the moisture or sweat coming out of a foot can be soaked up by the wood. Besides, the wooden sections are limited at the upper face, and cannot make up so much weight as to give heavy feeling to a foot.

Figure 4:
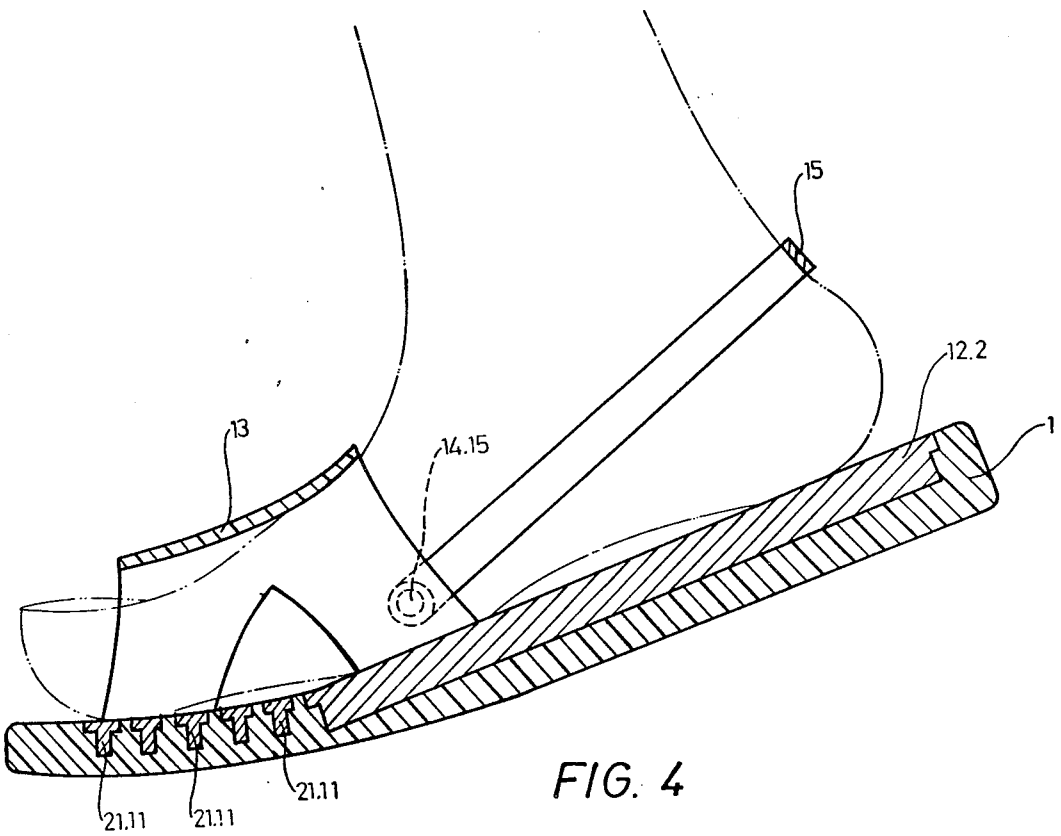
FIG. 4 is a side cross-sectional view of an example of the improved shoe sole combined in a sandal in a practical use.

The front half section of the shoe sole, as FIG. 4 shows, has a plurality of wooden parallel strips filled and arranged crosswise and a little apart in the upper face, possible to bend properly so that a wearer may feel comfortable in walking.

In general, a sandal or slipper combined with the shoe sole made according to the present invention can be worn for a long period of time without giving a hot feeling to a wearer and comparatively safe from getting a skin disease such as athlete's foot.

What is claimed is:

1. A shoe sole structure comprising:

a flexible sole having a front portion provided with a plurality of spaced parallel transverse grooves in an upper face thereof and wooden strips located in the grooves; and a rear portion provided with a recess in an upper face thereof extending over a major portion of the rear portion and a wooden board located in the recess.

2. The shoe sole structure according to claim 1, wherein the wooden strips and the wooden board are glued in position in the grooves and the recess, respectively.

3. The shoe sole structure according to claim 1, wherein the sole is of rubber.

4. A shoe having a sole structure according to claim 1.

* * * * *